US005915329A

United States Patent [19]

Watkins et al.

[11] Patent Number: 5,915,329

[45] **Date of Patent: *Jun. 29, 1999**

[54] SEAT ARRANGEMENT FOR WATERCRAFT

[75] Inventors: Scott Watkins, Huntington Beach, Calif.; Toshiyuki Hattori, Iwata, Japan

[73] Assignee: Yamaha Hatsudoki Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/709,621

[22] Filed: Sep. 9, 1996

[51] Int. Cl.[6] ..... B63B 17/00

[52] U.S. Cl. ..... 114/363; 114/362; 297/183.7; 297/195.12

[58] Field of Search ..... 114/362, 363, 114/270; 297/183.7, 195.1, 195.12, 195.11, 215.1, 215.11

[56] References Cited

U.S. PATENT DOCUMENTS

| | | | |
|---|---|---|---|
| Re. 34,922 | 5/1995 | Hattori et al. . | |
| 3,483,844 | 12/1969 | Trautwein | 114/270 |
| 3,485,527 | 12/1969 | Barghout | 297/183.7 |
| 4,318,700 | 3/1982 | Price | 114/363 |
| 4,411,214 | 10/1983 | Horiuchi . | |
| 4,625,986 | 12/1986 | Kassai | 297/215.1 |
| 4,673,212 | 6/1987 | Mayer | 297/195.12 |
| 5,237,950 | 8/1993 | Abe et al. | 114/363 |
| 5,255,626 | 10/1993 | Hattori et al. . | |
| 5,320,059 | 6/1994 | Ikeda . | |
| 5,372,082 | 12/1994 | Hattori . | |
| 5,406,904 | 4/1995 | Kobayashi | 114/363 |
| 5,537,948 | 7/1996 | Kobayashi | 114/362 |
| 5,544,937 | 8/1996 | Hanagan | 297/195.12 |

FOREIGN PATENT DOCUMENTS

| | | | |
|---|---|---|---|
| 2686055 | 7/1993 | France | 114/363 |
| 22696 | 1/1989 | Japan | 114/363 |
| 268293 | 3/1990 | Japan | 114/363 |

*Primary Examiner*—Sherman Basinger
*Attorney, Agent, or Firm*—Knobbe, Martens, Olson & Bear, LLP

[57] ABSTRACT

A straddle-type seat for a personal watercraft includes an operator seating portion and a juxtaposed passenger seating portion. A generally incurved seat support is provided between the operator seating portion and the passenger seating portion. The seat support includes a generally vertical rear face that provides back support for an occupant facing rearward in the passenger seating portion during operation or servicing of the watercraft and a generally incurved front face that includes a transversely extending member for supporting an occupant sitting in the operator seating portion during operation of the watercraft.

41 Claims, 6 Drawing Sheets

SEAT ARRANGEMENT FOR WATERCRAFT

BACKGROUND OF THE INVENTION

This invention relates generally to a personal watercraft seat and more particularly to a personal watercraft seat that provides greater versatility for use by a rider.

Small watercrafts of the "personal" type have become increasingly popular in recent years. It has been appreciated that the utility and enjoyment of this type of watercraft is expanded if the watercraft is designed to carry more than one rider. As a result, personal watercrafts have evolved from a single-rider design to multiple-rider designs.

Although designing a personal watercraft to accommodate multiple riders generally increases the utility and enjoyment of the watercraft, multiple-rider operation tends to decrease the sportiness of the personal watercraft. One reason for this decrease in sportiness is that sporty watercraft maneuvers require cooperative movements and teamwork. This is often difficult to do. Another reason for the decrease in sportiness, which is related to the first reason, is that multiple riders tend to interfere with each other's balance, stability and support during sporty maneuvers, especially during sharp turns. When the personal watercraft negotiates a turn, centrifugal forces cause the riders to be shifted away from the turn. The riders counteract these forces by leaning into the turn and firmly grabbing around the waist of a forward rider.

Although grabbing around the waist of a forward rider is an effective way to gain enough support to counteract the forces in a soft turn, it is not an effective way to counteract the forces in a sharp turn or a sporty watercraft maneuver because the rearward riders tend to unbalance the forward riders of the watercraft. It has therefore become desirable to provide support arrangements in personal watercrafts that provide the rider with additional support during watercraft operation.

One support arrangement in the past included an operator seat with a back rest that provided an operator with back support during operation of the watercraft. This arrangement also included a handlebar assembly at the top of the back rest for providing a standing rearward passenger with support during operation of the watercraft. The problem with this arrangement was that the handlebar assembly for the passenger was not designed to provide support for a seated passenger.

Additional handle arrangements that provide support for seated passengers have been employed in the past. One of these arrangements included a pair of rigid handles located on the sides of the raised pedestal, directly below the seat. Another handle arrangement included a nylon handle strap located directly on top of the seat between passenger sections. A rider would use these handle arrangements to gain additional support during operation of the watercraft. These arrangements were designed to be flush with the seat or located below the seat so that they would not hinder a rider on the seat. Although the location of these handle arrangements prevented them from interfering with a rider on the seat, their location also prevented them from providing much longitudinal support for a rider. If sporty operation of the watercraft suddenly caused a rider to be thrusted forward, these handle arrangements were not in a location to provide much support for counteracting this forward thrust.

When the personal watercraft is stopped on the water, a rider may turn around in the seat so as to face in a rearward direction in order to watch another watercraft, or other activity, carrying on behind the personal watercraft. If the personal watercraft is rolled or pitched by a wave while the rider is seated in this fashion, the rider may be forced into the back of the operator.

When servicing the jet propulsion unit, a service person, such as a mechanic, would also sit on the watercraft seat in a rearward fashion. From this position, the service person could service the jet propulsion unit located below the removable rear seat. The service person would often experience back fatigue during this process because personal watercraft seats in the past did not provide back support for an occupant in this situation.

It will be shown by the ensuing description of the present invention how the present invention overcomes these problems.

SUMMARY OF THE INVENTION

A straddle-type seat for a personal watercraft includes an operator seating portion and a juxtaposed passenger seating portion. A generally incurved seat support is provided between the operator seating portion and the passenger seating portion. The seat support includes a generally vertical rear face that provides back support for an occupant facing rearward in the passenger seating portion during operation or servicing of the watercraft and a generally incurved front face that includes means for transversely supporting an occupant sitting in the operator seating portion during operation of the watercraft.

DETAILED DESCRIPTION OF THE PREFERRED EMBODIMENT

Figure 1:
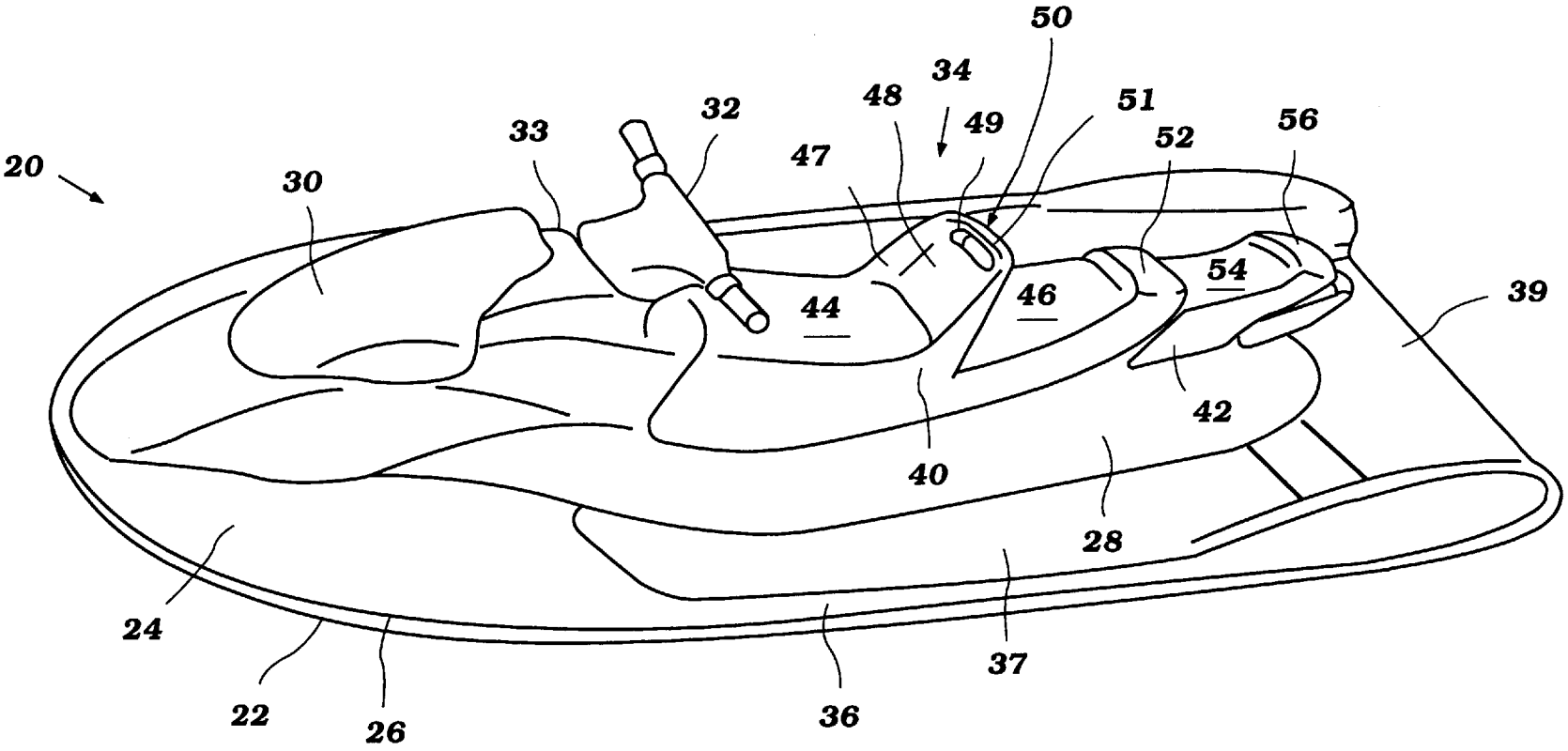
FIG. 1 is a perspective view of an embodiment of the seat of the present invention on a personal watercraft.

Referring now in detail to the drawings, and initially to FIG. 1, a small watercraft having a seat constructed in accordance with an embodiment of the invention is identified generally by the reference numeral 20. The small watercraft 20 in the illustrated embodiment is of the personal type and includes a hull having a lower hull portion 22 and an upper deck portion 24 that are secured together along their peripheral edges at a gunnel 26 that extends around the outer periphery of the watercraft. The hull portions 22 and 24 are formed from a suitable material, such as molded fiberglass reinforced resin or the like.

The watercraft 20 is powered by a jet propulsion unit (not shown) which is mounted in a tunnel formed beneath a raised pedestal 28 of the upper deck portion 24. An engine (not shown) is mounted in a forward compartment, under an operator seating portion 44, and drives the jet propulsion unit in a known manner in the art.

The jet propulsion unit has a steering nozzle (not shown) that is supported for steering about a vertically extending steering axis. A handlebar assembly 32 is mounted on a raised bridge 33 for steering the steering nozzle in a known manner in the art.

A portion of the raised pedestal 28 located to the rear of the hatch cover 30 accommodates a seat assembly, indicated generally by the reference numeral 34, which is constructed in accordance with a first embodiment of the invention. The seat assembly 34, which will be described in more detail below, is adapted to seat an operator and one or more passengers in a straddle, tandem-type fashion. To this end, a pair of raised gunnels 36 are provided. The raised gunnels 36 are spaced outwardly from the raised pedestal 28. The areas between the raised pedestal 28 and raised gunnels 36 form foot areas 37 on which the operator and passengers may place their feet. A rear part of the foot areas 37 opens into a boarding platform 39 for assisting the riders in boarding the watercraft and draining water from the foot areas 37.

A first embodiment of the invention will now be described in more detail. The seat assembly 34 includes a removable front seat 40 and rear seat 42. The removable front seat 40 allows access to the engine area. The front seat 40 is divided into an operator seating portion 44 and a first passenger seating portion 46 by a generally incurved back rest or seat support 48. The seat support 48 is formed integrally with front seat 40 and extends generally vertically therefrom.

The seat support 48 has a generally incurved front side that includes generally incurved lateral or transverse support members 47 that provide the operator with significant transverse support, especially in the hip area, during sporty operation of the watercraft. This support is maximized if the operator braces his or her back firmly between the transverse support members 47. This bracing action is accomplished by applying pressure to the foot areas 37 through the operator's legs. The generally vertical nature of the seat support 48 also supplies longitudinal back support for the operator.

A rear side of the seat support 48 is designed to provide a rider or service person turned around on the first passenger seating portion 46 with longitudinal back support. When the personal watercraft is stopped on the water, a rider may face in a rearward direction on the seat in order to watch another watercraft, or other activity, carrying on behind the personal watercraft. If the personal watercraft is rolled or pitched by a wave while the rider is seated in this fashion, the rider may be forced into the back of the operator. A service person, such as a mechanic, may also face in a rearward fashion on the seat in order to gain access to and service the jet propulsion unit located beneath the removable rear seat. The service person often experiences back fatigue during this servicing process because personal watercraft seats have not provided support for this situation. The rear side of the seat support 48 has a generally vertical construction and height that provides a rearward facing rider or service person on the passenger seating portion 46 with longitudinal back support that eliminates these problems.

The seat support 48 also includes a generally rectangular, elongated aperture 49 near the top of seat support 48 that forms an assist grip or handle arrangement 50 for a passenger seated in the first passenger seating portion 46. The assist grip 50 comprises a handle 51 formed integrally with seat support 48 at the top of the seat support 48. The assist grip 50 is located forward of, and at an elevated position relative to, the first passenger seating portion 46. And the handle 51 of the assist grip 50 is positioned entirely between the sides of the assembly 34.

The assist grip 50 provides a rider with additional support, balance and stability during operation of the watercraft and is especially useful during sporty operation of the watercraft. Handle arrangements in the past were designed to be flush with the seat or located below the seat so that they would not hinder a rider on the seat. Although the location of these handle arrangements prevented them from interfering with a rider on the seat, their location also prevented them from providing much longitudinal support for a rider. If sporty operation of the watercraft suddenly caused a rider to be thrusted forward, these handle arrangements were not in a location to provide much support for counteracting this forward thrust. The forward and elevated location of the assist grip 50 with respect to the rider prevents this problem because it allows the assist grip 50 to furnish longitudinal and lateral support during sporty operation of the watercraft.

A low-profile seat support 52 is provided at the rear of the first passenger seating portion 46 and serves mostly to separate the first passenger seating portion 46 from a second passenger seating portion 54 and prevent the first passenger from sliding rearward. If a rider is facing rearward in the first passenger seating portion 46, as mentioned above, the rider may use this support 52 for additional support during operation of the watercraft or for servicing.

The second passenger seating portion 54 is provided in the removable rear seat 42 and is designed to accommodate a second passenger. A removable storage container is provided beneath the rear seat 42 for storing personal items and allowing access to the jet propulsion unit. A low-profile seat support 56, similar to seat support 52, is furnished at the rear of rear seat 42 and serves mostly to prevent a second passenger from sliding rearward, off the rear of the watercraft.

As is typical with personal watercraft seat assemblies, the seat assembly 34 has a gradual upward incline that provides a higher seating position as one progresses rearwardly on the seating assembly 34. This gradual upward incline permits the riders to adjust the elevation of their line of vision, by sliding forward or rearward on the seat assembly 34, without leaving the seat assembly 34.

Figure 2:
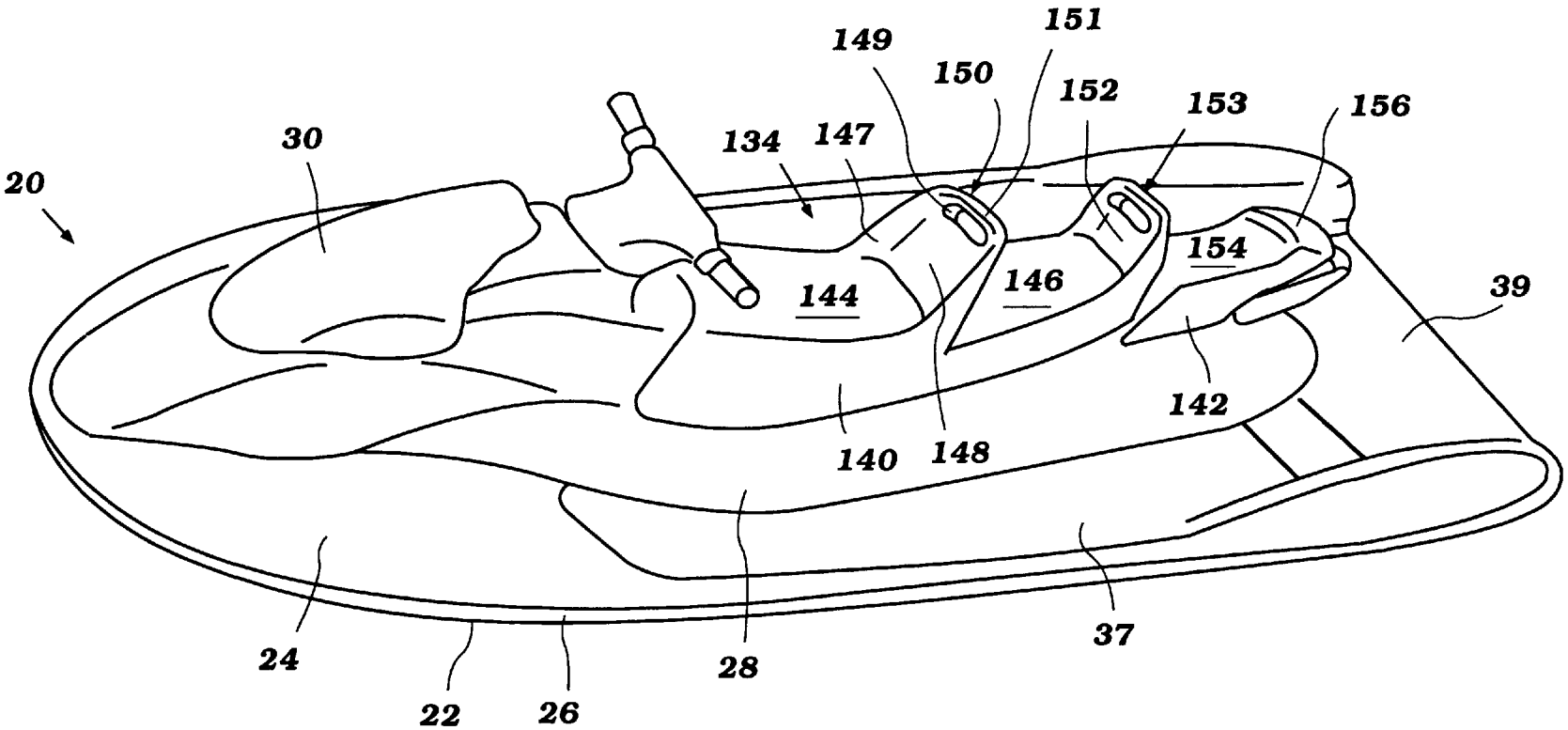
FIG. 2 is a perspective view of a second embodiment of the seat of the present invention on a personal watercraft.

Referring to FIG. 2, a second embodiment of the invention will now be described. This embodiment is similar to the first embodiment of the invention but provides additional support for more riders than the first embodiment. A seat assembly 134 includes a removable front seat 140 and rear seat 142. The front seat 140 is divided into an operator seating portion 144 and a first passenger seating portion 146 by a generally incurved seat support 148 that is similar to the aforenoted seat support 48 of FIG. 1. The seat support 148 has a generally incurved front side that includes a pair of generally incurved transverse support members 147 that serve the same function as support members 47 mentioned above. A rear side of the seat support 148 has a generally vertical construction and height that provides back support for a first passenger or service person seated in a rearward direction in the manner described above.

A generally rectangular, elongated aperture 149 is provided near the top of seat support 148 and forms an assist grip 150. Assist grip 150 is formed integrally with the seat support 148 and includes a handle 151 that furnishes support for a first passenger in the manner described above.

A second generally incurved seat support 152 is provided at the rear of the first passenger seating portion 146. The seat support 152 has a generally incurved front side that includes a pair of generally incurved transverse support members. A rear side of the seat support 148 has a generally vertical construction and height that provides back support for a passenger seated in a rearward direction on a second passenger seating portion, to be described. An assist grip 153, similar to assist grip 150, is formed integrally with the top of seat support 152 and serves the same function as assist grip 150 but for a second passenger. Assist grip 153 may also provide a rider or service person seated in a rearward fashion in the first passenger seating portion 146 with additional support.

The second passenger is seated in a second passenger seating portion 154 formed in rear seat 142. A low-profile seat support 156 is provided at the rear of the second passenger seating portion 154 and serves mostly to prevent the second passenger from sliding off the rear of the watercraft. The seat support 156 may also provide additional support for a rider facing in a rearward direction on the second passenger seating portion 154.

Figure 3:
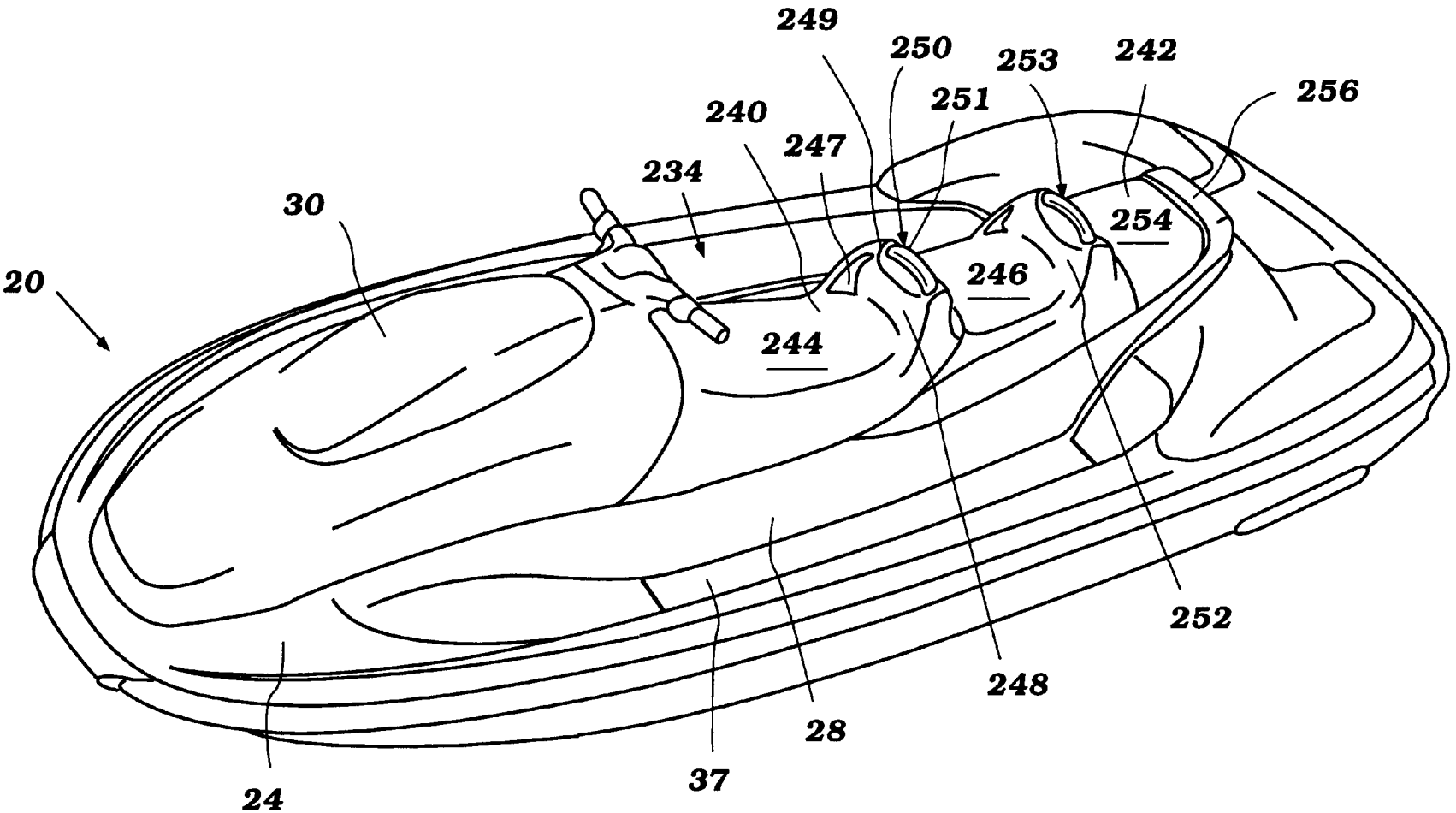
FIG. 3 is a perspective view of a third embodiment of the seat of the present invention on a personal watercraft.

Referring to FIG. 3, a third embodiment of the invention will now be described. A seat assembly 234 includes a removable front seat 240 and rear seat 242. The front seat 240 is divided into an operator seating portion 244 and a first passenger seating portion 246 by a generally incurved seat support 248. The seat support 248 has a generally incurved front side that includes generally incurved transverse support members 247 that provide transverse support in the same manner as that described for the earlier seat embodiments. A rear side of seat support 248 has a generally vertical construction and height that allows it to provide longitudinal back support for a passenger or service person seated in a rearward direction in the first passenger seating portion 246.

The top of the seat support 248 includes a curved cut-out portion 249. An assist grip 250 is provided at the top of seat support 248. The assist grip 250 comprises a curved handle 251 connected at opposite ends of the handle 251 to opposite ends of the curved cut-out portion 249. The curved handle 251 provides additional support for a first passenger in the same manner as that described above for the earlier embodiments.

A second generally incurved seat support 252, similar to seat support 248, is provided at the rear of the first passenger seating portion 246. Seat support 252 also includes an assist grip 253 that is similar in construction to assist grip 250. The assist grip 253 may be used for additional support by a passenger or service person seated in a rearward direction on the first passenger seating portion 246.

The seat support 252 has a generally incurved front side that includes a pair of generally incurved transverse support members. A rear side of seat support 248 is designed to provide back support for a passenger seated in a rearward direction on a second passenger seating portion, to be described.

A second passenger seating portion 254 is formed in the rear seat 242. A low-profile seat support 256 is furnished at the rear of second passenger seating portion 254 and serves mostly to prevent a second passenger from sliding off the rear of the watercraft. The seat support 256 may also be used for additional support by a passenger seated in a rearward direction on the second passenger seating portion 254.

The generally incurved seat supports 248 and 252 have a slightly lower profile than the generally incurved seat supports described previously. The lower profile of these supports prevents the seat supports 248 and 252 from interfering with the riders, especially when operating the watercraft from a standing position.

Figure 4:
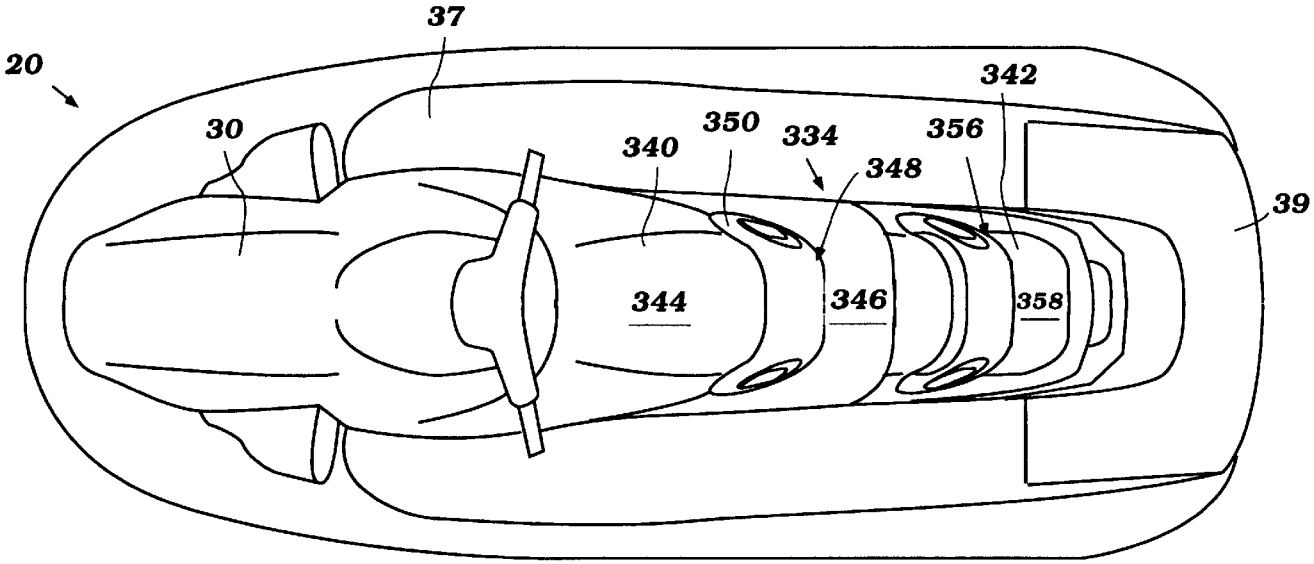
FIG. 4 is top plan view of a fourth embodiment of the seat of the present invention on a personal watercraft.
Figure 5:
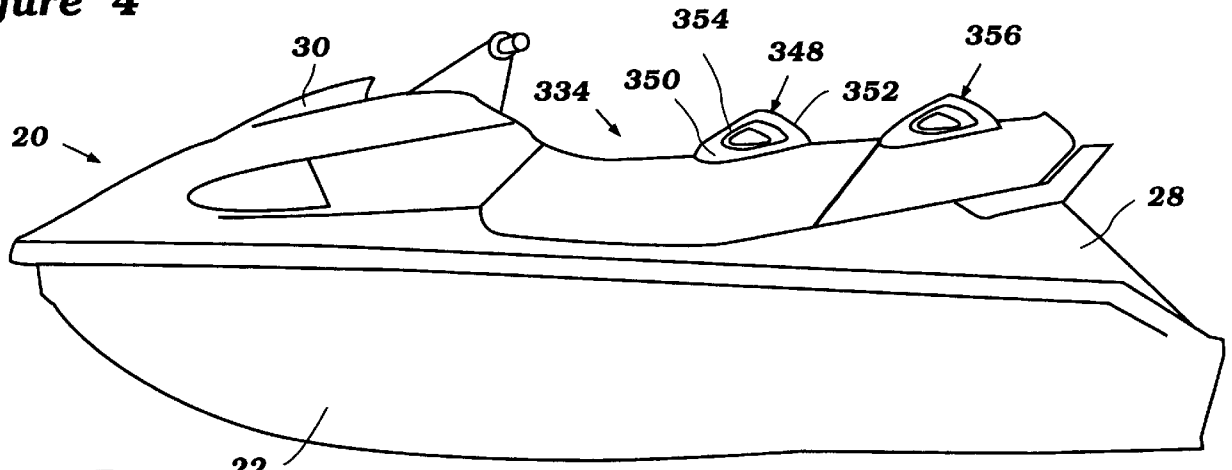
FIG. 5 is a side elevational view of the seat embodiment of FIG. 4.

Referring to FIGS. 4 and 5, a fourth embodiment of the invention will now be described. A seat assembly 334 includes a removable front seat 340 and rear seat 342. The front seat 340 is divided into an operator seating portion 344 and a first passenger seating portion 346 by a combined seat support and assist grip assembly 348 that is formed separately from the front seat 340. The separate nature of the combined seat support and assist grip assembly 348 allows additional support to be added to a preexisting watercraft seat. This assembly 348 includes a pair of generally incurved transverse support members 350 that provide transverse support for an operator in the same manner as that described earlier. The generally incurved transverse support members 350 are connected by a downwardly-angled rear face 352. Each of the generally incurved support members 350 include an upwardly angled aperture 354 that is designed for a passenger to insert his or her hands through for gripping the assembly 348 for gaining additional support in the manner described above.

A second seat support and assist grip assembly 356, similar in construction and function to assembly 348, is provided between the first passenger seating portion 346 of the front seat 340 and a second passenger seating portion 358 of the rear seat 342.

Figure 6:
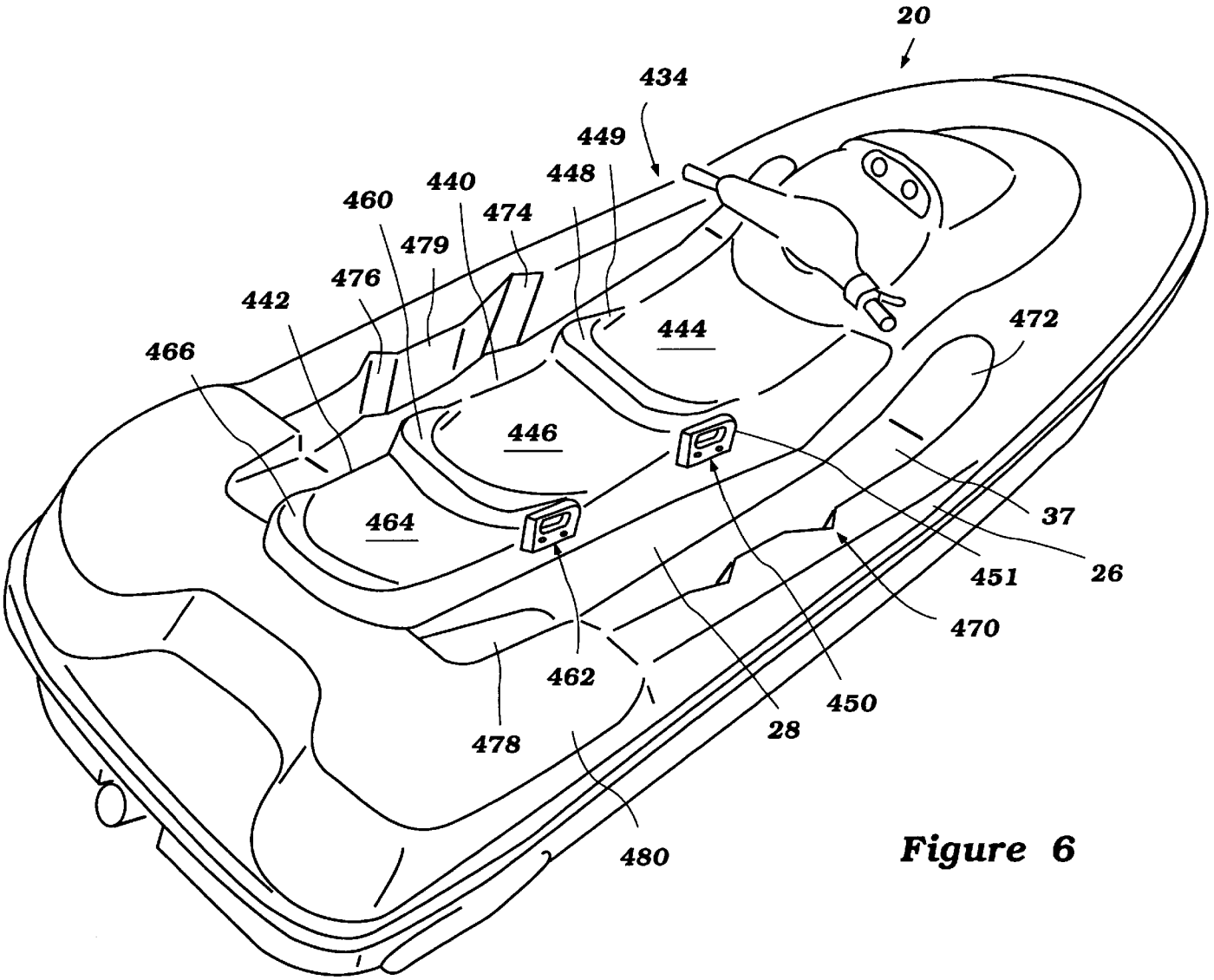
FIG. 6 is a perspective view of a fifth embodiment of the seat of the present invention on a personal watercraft.
Figure 8:
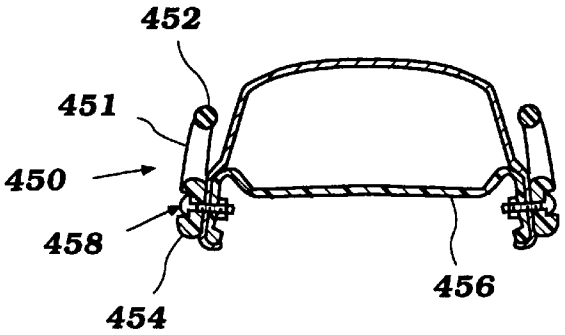
FIG. 8 is a cross-sectional view of the seat of FIG. 7 taken along line 8—8 of FIG. 7.
Figure 7:
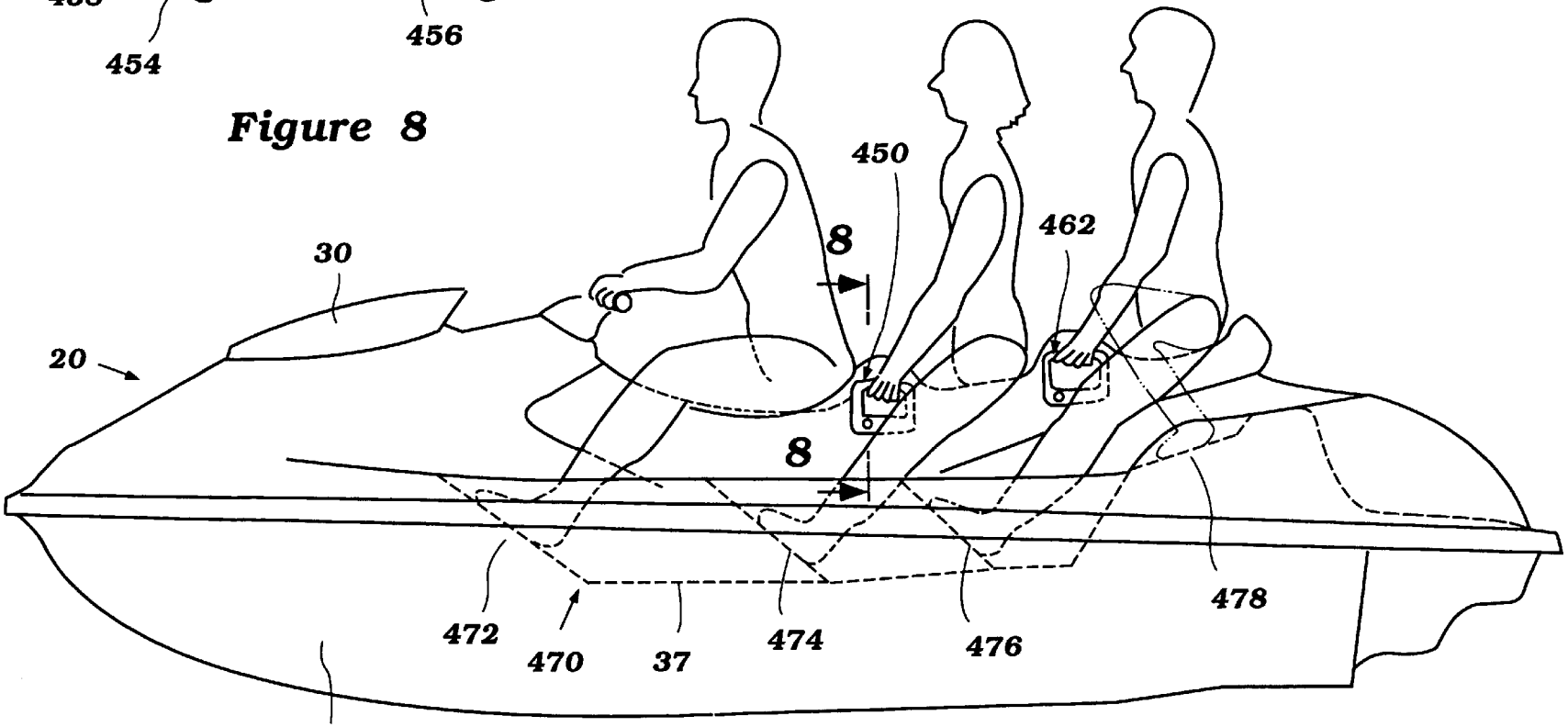
FIG. 7 is a side elevational view, with parts of it shown in phantom, of the seat embodiment of FIG. 6 with a plurality of riders shown on the seat.

Referring to FIGS. 6–8, a fifth embodiment of the invention will now be described. A seat assembly 434 includes a removable front seat 440 and rear seat 442. The front seat 440 includes an operator seating portion 444 divided from a first passenger seating portion 446 by a generally incurved seat support 448. The generally incurved seat support 448 includes an even lower profile than the generally incurved seat supports described in the third embodiment of the invention. The lower profile of this support 448 provides even less interference with the operator, especially when the operator runs the watercraft from a standing position. The generally incurved seat support 448 includes generally incurved transverse support members 449 that provide transverse support for the operator in same the manner as the transverse support members described earlier.

The generally incurved seat support 448 includes an assist grip or handle arrangement 450. This arrangement 450 includes a pair of handles 451 located at opposite sides of the seat support 448. Each handle 451 includes a gripping portion 452 (FIG. 8) and a mounting portion 454. The gripping portion 452 is located at a slightly elevated and forward position relative to the front of the first passenger seating portion 446. The location of the gripping portions 452 of the handles 451 allows the assist grip 450 to provide lateral and longitudinal support for the first passenger during operation of the watercraft. The mounting portion 454 of each handle 451 is mounted to a bottom seat plate 456 of the front seat 440 by a bolt and nut combination 458.

A second generally incurved seat support 460 and assist grip 462, similar to seat support 448 and assist grip 450, are provided at the rear of the first passenger seating portion 446. At the rear of a second passenger seating portion 464, a low-profile seat support 466 is provided. The low-profile seat support 466 serves mostly to prevent a second passenger from sliding off of the rear seat 442.

The seat assembly of the present invention may also include a foot support assembly 470 that supplies additional support for the riders during normal and sporty operation of the watercraft. The foot support assembly 470 includes operator foot supports 472, first passenger foot supports 474, second passenger lower foot supports 476 and second passenger upper foot supports 478.

The operator foot supports 472 are located at the forwardmost end of the foot areas 37 and have an upwardly and slightly outwardly angled construction that provides the operator of the watercraft with additional longitudinal and transverse support during watercraft operation.

The first passenger foot supports 474 are located in inner walls 479 of the raised gunnels 26. The first passenger foot supports 474 have an upwardly and outwardly angled construction that allows them to provide additional longitudinal and transverse support for the first passenger during watercraft operation. The operator and first passenger may also use their legs and these foot supports 472 and 474 for bracing themselves against the generally incurved seat supports 448 and 460, respectively, for assisting the generally incurved seat supports 448 and 460 in providing transverse support during watercraft operation.

The second passenger foot supports 476 are located to the rear of the first passenger foot supports 474 and have a similar construction to the first passenger foot supports 474. The second passenger upper foot supports 478 provide an additional area on which a second passenger, especially a child, may place his or her feet for support. The upper foot supports 478 have a downwardly-angled construction and are located between the raised pedestal 28 and a rear storage assembly 480.

It should be readily apparent from the foregoing description that the described embodiments of the invention provide significant additional support for at least one rider during normal and sporty operation of the watercraft. Of course, the described embodiments are preferred embodiments of the invention and various changes and modifications may be made without departing from the spirit and scope of the invention as defined by the appended claims.

What is claimed is:

1. A straddle-type seat for a personal watercraft comprising an operator seating portion and a juxtaposed passenger seating portion, a generally incurved seat support provided between the operator seating portion and the passenger seating portion and including a pair of transversely positioned support members located opposite to each other and arranged to transversely support an occupant sitting in said operator seating portion during operation of the watercraft, and a handle arrangement located at a point along a longitudinal axis of the watercraft generally between the operator seating portion and the passenger seating portion, and having at least one generally rigid handle arranged to provide an occupant sitting in said passenger seating portion with significant longitudinal and transverse support when grasped by the occupant during operation of the watercraft, said handle being positioned entirely between transverse sides of the seat.

2. The straddle-type seat of claim 1, wherein said transversely positioned support members are generally incurved.

3. The straddle-type seat of claim 1, wherein the handle arrangement is formed integrally with the generally incurved seat support.

4. The straddle-type seat of claim 3, wherein the generally incurved seat support includes a top end, the handle arrangement includes a handle formed near the top end of the generally incurved seat support.

5. The straddle-type seat of claim 3, wherein the generally incurved seat support is formed separately from the seat and includes a pair of opposite sides, the handle arrangement includes a corresponding pair of opposite handles located at said opposite sides of the generally incurved seat support.

6. The straddle-type seat of claim 1, wherein the handle arrangement is formed separately from the generally incurved seat support.

7. The straddle-type seat of claim 6, wherein said generally incurved seat support includes a top end, the handle arrangement is formed by a separate handle attached near the top end of the generally incurved seat support.

8. The straddle-type seat of claim 6, wherein the generally incurved seat support includes a pair of opposite sides, the handle arrangement includes a corresponding pair of opposite handles attached to said opposite sides of the generally incurved seat support.

9. The straddle-type seat of claim 1, wherein the passenger seating portion includes a juxtaposed first passenger seating portion and second passenger seating portion, a second generally incurved seat support is provided between the first passenger seating portion and second passenger seating portion and includes means for transversely supporting an occupant sitting in said first passenger seating portion during operation of the watercraft.

10. The straddle-type seat of claim 9, wherein the transversely supporting means include a pair of generally incurved support members located opposite to each other.

11. The straddle-type seat of claim 9, wherein the second generally incurved seat support includes a handle arrangement having at least one handle that provides an occupant seated in said second passenger seating portion with significant longitudinal and transverse support during operation of the watercraft.

12. The straddle-type seat of claim 11, wherein the handle arrangement is formed integrally with the second generally incurved seat support.

13. The straddle-type seat of claim 12, wherein the second generally incurved seat support includes a top end, the handle arrangement includes a handle formed near the top end of the second generally incurved seat support.

14. The straddle-type seat of claim 11, wherein the second generally incurved seat support is formed separately from the seat and includes a pair of opposite sides, the handle arrangement includes a corresponding pair of opposite handles formed at said opposite sides of the second generally incurved seat support.

15. The straddle-type seat of claim 11, wherein the handle arrangement is formed separately from the second generally incurved seat support.

16. The straddle-type seat of claim 15, wherein the second generally incurved seat support includes a top end, the handle arrangement is formed by a separate handle attached near the top end of the second generally incurved seat support.

17. The straddle-type seat of claim 15, wherein the second generally incurved seat support includes a pair of opposite sides, the handle arrangement includes a corresponding pair of opposite handles attached to said opposite sides of the second generally incurved seat support.

18. A small watercraft as in claim 1, wherein the handle arrangement is located behind the operator seating portion.

19. A small watercraft comprising a straddle-type seat including an operator seating portion and a juxtaposed passenger seating portion, a generally incurved seat support provided between the operator seating portion and the passenger seating portion, said seat support having a generally vertical rear side that provides back support for an occupant seated in a rearward fashion in the passenger seating portion and a generally incurved front side that includes means for transversely supporting an occupant seated in the operator seating portion during operation of the watercraft, and foot areas provided along side the straddle-type seat said foot areas extending forward of the passenger seating portion to accommodate a passenger seated in the passenger seating portion in a forward fashion, and extending behind the passenger seating portion to accommodate a passenger seated in a rearward fashion in the passenger seating portion.

20. The straddle-type seat of claim 19, wherein said transversely supporting means include a pair of generally incurved support members located opposite to each other.

21. The straddle-type seat of claim 19, wherein said generally incurved seat support includes a handle arrangement having at least one handle that provides an occupant sitting in said passenger seating portion with significant longitudinal and transverse support during operation of the watercraft.

22. The straddle-type seat of claim 21, wherein the handle arrangement is formed integrally with the generally incurved seat support.

23. The straddle-type seat of claim 22, wherein the generally incurved seat support includes a top end, the handle arrangement includes a handle formed near the top end of the generally incurved seat support.

24. The straddle-type seat of claim 21, wherein the handle arrangement is formed separately from the generally incurved seat support.

25. The straddle-type seat of claim 24, wherein said generally incurved seat support includes a top end, the handle arrangement is formed by a separate handle attached near the top end of the generally incurved seat support.

26. The straddle-type seat of claim 19, wherein the passenger seating portion includes a juxtaposed first passenger seating portion and second passenger seating portion, a second generally incurved seat support is provided between the first passenger seating portion and second passenger seating portion, the second generally incurved seat support includes a generally vertical rear side that provides back support for an occupant seated in a rearward fashion in the second passenger seating portion and a generally vertical incurved front side that includes means for transversely supporting an occupant seated in the first passenger seating portion during operation of the watercraft.

27. The straddle-type seat of claim 26, wherein the transversely supporting means include a pair of generally incurved support members located opposite to each other.

28. The straddle-type seat of claim 26, wherein the second generally incurved seat support includes a handle arrangement having at least one handle that provides an occupant seated in a rearward fashion in the first passenger seating portion and an occupant seated in the second passenger seating portion with significant longitudinal and transverse support during operation of the watercraft.

29. The straddle-type seat of claim 28, wherein the handle arrangement is formed integrally with the second generally incurved seat support.

30. The straddle-type seat of claim 29, wherein the second generally incurved seat support includes a top end, the handle arrangement includes a handle formed near the top end of the second generally incurved seat support.

31. The straddle-type seat of claim 28, wherein the handle arrangement is formed separately from the second generally incurved seat support.

32. The straddle-type seat of claim 31, wherein the second generally incurved seat support includes a top end, the handle arrangement is formed by a separate handle attached near the top end of the second generally incurved seat support.

33. The straddle-type seat of claim 19, wherein the passenger seating portion includes a juxtaposed first passenger seating portion and second passenger seating portion, the seat support is provided between the operator seating portion and the first passenger seating portion, said second passenger seating portion is removable from said first passenger seating portion.

34. A small watercraft comprising an elongated straddle-type seat including an operator seating portion and at least one passenger seating portion, a seat support positioned between the operator seating portion and the passenger seating portion, the seat support having a generally vertical rear side that provides back support for an occupant seated in a rearward fashion in the passenger seating portion and a generally incurved front side that includes a pair of transversely positioned support members, and foot areas provided along the straddle-type seat and in a direction generally parallel to the seat, said foot areas extending continuously from forward of the passenger seating portion to accommodate a passenger seated in the passenger seating portion in a forward fashion, to rearward of the passenger seating portion to accommodate a passenger seated in a rearward fashion in the passenger seating portion.

35. A small watercraft as in claim 34, wherein said foot areas including a pair of generally upstanding, inclined foot supports positioned forward of the operator seating portion.

36. A small watercraft as in claim 35, wherein the foot areas include a second pair of generally upstanding, inclined foot supports positioned behind the first pair of generally upstanding, inclined foot supports.

37. A small watercraft as in claim 36, additionally comprising a pair of raised gunnels that extend along side the foot areas, and at least one of the pairs of foot supports being integrally formed into inner side walls of the raised gunnels.

38. A small watercraft comprising a hull having a pair of longitudinally extending raised gunnels, a straddle-type seat centrally positioned between the gunnels and extending generally parallel thereto, and at least one pair of generally upstanding, inclined foot supports which are located in side walls of the raised gunnels adjacent to the seat, the foot supports being inclined in a longitudinal direction, generally parallel to the seat.

39. A small watercraft as in claim 38, wherein the seat includes an operator seating portion and a passenger seating portion, and a support located between the operator and passenger seating portions.

40. A small watercraft as in claim 39, wherein the support includes a generally vertical rear side that provides back support for an occupant seated in a rearward fashion in the passenger seating portion and a generally incurved front side.

41. A small watercraft as in claim 40, further comprising foot areas provided along the straddle-type seat, wherein the foot areas extend forward of the passenger seating portion to accommodate a passenger seated in the passenger seating portion in a forward fashion, and extend behind the passenger seating portion to accommodate a passenger seated in a rearward fashion in the passenger seating portion.

* * * * *